United States Patent [19]

Friedrich

[11] Patent Number: 4,955,664

[45] Date of Patent: Sep. 11, 1990

[54] VEHICLE, ESPECIALLY A LOADER

[75] Inventor: Karl Friedrich, Sipplingen, Fed. Rep. of Germany

[73] Assignee: Kramer-Werke Gmbh, Bodensee, Fed. Rep. of Germany

[21] Appl. No.: 318,665

[22] Filed: Mar. 3, 1989

[30] Foreign Application Priority Data

Mar. 12, 1988 [DE] Fed. Rep. of Germany ..... 3808314

[51] Int. Cl.[5] ..... B62D 21/07

[52] U.S. Cl. ..... 296/204; 280/790

[58] Field of Search ..... 296/204; 280/785, 790

[56] References Cited

U.S. PATENT DOCUMENTS

| | | | |
|---|---|---|---|
| 3,924,702 | 12/1975 | Heggen | 296/204 |
| 4,154,471 | 5/1979 | Long | 296/204 |
| 4,342,470 | 8/1982 | Matsuda | 280/785 |
| 4,583,761 | 4/1986 | Negel et al. | 280/790 |
| 4,840,424 | 6/1989 | Asoh | 296/204 |

FOREIGN PATENT DOCUMENTS

| | | |
|---|---|---|
| 3525251 | 3/1987 | Fed. Rep. of Germany . |
| 2905528 | 3/1988 | Fed. Rep. of Germany . |
| 84/02317 | 6/1984 | PCT Int'l Appl. . |

OTHER PUBLICATIONS

International Search Report No. PCT/EP 83/00322.

*Primary Examiner*—Robert R. Song

*Attorney, Agent, or Firm*—Helfgott & Karas

[57] ABSTRACT

A vehicle-carried loader having a loader boom articulated to its front end and a motor suspended at its rear end includes a stiff frame including longitudinal and transversal frame members. The longitudinal lateral frame members arch over the rear wheels and in the middle section of the vehicle run at the level of the vehicle floor adjoining the boarding step. The frame is additionally stiffened by the provision of additional frame parts. The longitudinal lateral frame members each have a front section extending partially over the front wheels, on which the front part of the vehicle is supported. The frame further has a central longitudinal frame member extending between the wheel axles and rearwardly to the rear end of the vehicle. The central frame member is connected directly or by struts to several transversal frame members and has on its bottom axle flanges for fastening the rear axle.

17 Claims, 2 Drawing Sheets

VEHICLE, ESPECIALLY A LOADER

BACKGROUND OF THE INVENTION

The present invention relates to a vehicle, especially a loader with a loading boom articulated on its front end and a motor suspended at the rear of the vehicle, and with a stiff frame having longitudinal and transverse members, whose longitudinal side members extend to form arches over the rear wheels and, in the middle section of the vehicle, are at the level of the vehicle floor adjoining the boarding step.

A loader of this kind is disclosed in German Offenlegungsschrift No. 29 05 528. To enable this frame to be sufficiently stable even for vehicles with a short turning circle, in which case a high resistance to a frame torque is important, the longitudinal side frame members must be of appropriately heavy dimensions, which has the undesirable effect of increasing vehicle weight.

WO No. 84/12317 discloses a wheeled machine with a motor disposed alongside the driver's cabin, which has longitudinal frame members with front sections extending partially over the front wheels, on which the front part of the vehicle is built.

SUMMARY OF THE INVENTION

It is an object of the present invention to construct a vehicle of the foregoing type so as to be especially stiff while, at the same time, saving on weight, and to give the vehicle sufficient stability even for an especially great steering deflection of about 60°.

This object is accomplished in accordance with the invention by providing the longitudinal side members of the frame with a foward section extending partially over the front wheels, on which the front part of the vehicle is built, by providing on the frame a central longitudinal frame member extending between the wheel axes and rearwardly thereof towards the rear end of the vehicle, which central frame member is connected directly or by supports to a plurality of transversal bars, and on the bottom of which the axle flanges for mounting the rear axle are provided, and by additionally reinforcing the frame by mounting parts of the vehicle structure in the area of the back, the front and the running board of the frame.

By this integration of the vehicle's superstructure with its frame such that the body of the vehicle is also incorporated for additional stiffening, the longitudinal members of the frame can be made of smaller dimensions than in the state of the prior art, and yet an improved rigidity of the whole unit composed of the frame and the superstructure can be achieved by the proposed integration of parts of the superstructure into the frame in the area of the back, the front part and the running board.

This integration requires that a central longitudinal frame member be provided, which constitutes the essential core of the vehicle both longitudinally and transversely. Not only are the transversal frame members or bars directly or indirectly connected to the central longitudinal frame member, but through it the forces that have to be absorbed by the vehicle are applied to the load-bearing parts of the superstructure. To this extent the central longitudinal frame member is the central load-bearing element which, on the one hand, supports the rear box of the vehicle, loaded with the ballast weights, and, on the other hand, bears the weight of the drive unit and absorbs the thrust forces from the rear axle of the vehicle.

With this in mind, additional features of the invention provide that at least two lateral frame members are joined together at the rear ends thereof by a rear box-like structure which is also provided for the mounting of ballast weights, and that the rear box structure is made open at the top so as to contain the motor and units connected therewith, and furthermore that the box is internally reinforced by a rear beam form as a transversal member to which the rear end of the central longitudinal frame member is connected.

But not only the vehicle rear part but also the front part of the vehicle pertain to the load-bearing parts of the superstructure. In this connection it is proposed in accordance with the invention that the two lateral longitudinal frame members be joined together at the front by a front box-like structure composed of a left and a right box-shaped elements having between them a tunnel or recess open at the front, into which the loading shovel reaches which is attached at that point. The front box and the front sections of the longitudinal side frame members connected thereto, however, not only have to absorb considerable forces which are applied by the loading shovel, but also thrust forces of the front axle, and provision is made in accordance with the invention for the supporting walls of the tunnel section to be prolonged toward the front wheel axle by downwardly projecting axle plates, on the end of which axle flanges are provided for the mounting of the front axle. To deal with this problem several especially desirable developments are provided in accordance with the invention.

One such measure consists in the configuration of the two box-shaped parts which are open towards the driver's cabin, but otherwise are formed by a front plate, side plates and foot plate of the front end of the superstructure.

As an additional measure, front beams are provided in the interior of the box-shaped parts, which are formed as additional transversal members, which are connected at the outside to the front end of the associated longitudinal side frame member and on the inside to the adjacent side wall of the tunnel section.

Another measure consists in the fact that the central longitudinal frame member is in the form of a hollow beam in its between the rear-end box and the middle section of the vehicle where it is connected to a central transversal beam as a cross member. Alternatively, the central longitudinal frame member can also be configured as a box-shaped. Lastly, another very important measure consists in the fact that the central longitudinal frame member is prolonged in the foward direction by a tunnel in the form of a steel plate box open at the bottom or completely closed, which is connected at one end to the central transversal member and at the other end to the tunnel part of the front-end box.

To a certain extent this tunnel, as a prolongation of the central longitudinal frame member, is an important load-bearing element connecting the front part with the middle section of the vehicle, in addition to the longitudinal side girders. To further improve the load-bearing function of these components, provision is made in accordance with an additional feature of the invention for a floor plate to be fastened in the middle section on both sides of the tunnel and to extend forwardly, where it forms the floor of the associated part of the front box. In this manner a closed unit including the middle section of the vehicle and its front section is formed, which is connected by the central transversal member and the two longitudinal side frame members to the rear end of the vehicle, the central longitudinal member assuming the important supporting function between the central transversal member and the rear end of the vehicle.

Within the scope of the invention, additional transversal frame members are provided at a distance vertically above the central longitudinal frame member, namely a rear-end beam parallel to the upper edge of the rear end and a front beam parallel to the upper edge of the front-end box.

Furthermore, a transversal frame member is additionally provided to fasten the longitudinal side frame members together over the rear wheels and whose extremities are connected to the central transversal frame member by struts. The struts engage the central longitudinal frame member, preferably between the flanges provided for mounting the rear axle. In this manner a vertical combination of the central longitudinal frame member, the two struts, the transversal frame member and thus the longitudinal side frame members is available to absorb the thrust of the rear axle.

Additional important features of the invention relate to the integration of plate components of the vehicle's superstructure into the load-bearing function of the frame.

One such feature provides that at least a part of the transversal frame members is created by forming a box section on portions of plates of the superstructure or by shaping a box section from such plates. This eliminates the need for installing separate beams.

Another feature of the invention calls for the plates forming the rear wheel wells to be welded together and to the longitudinal side frame members and central longitudinal frame member to form a rigid component. This component greatly assists the operation of the struts and of the transversal frame member joining the two longitudinal side frame members over the rear wheels.

An embodiment of the invention is explained below in conjunction with the drawing.

DETAILED DESCRIPTION OF THE PREFERRED EMBODIMENT

Figure 1:
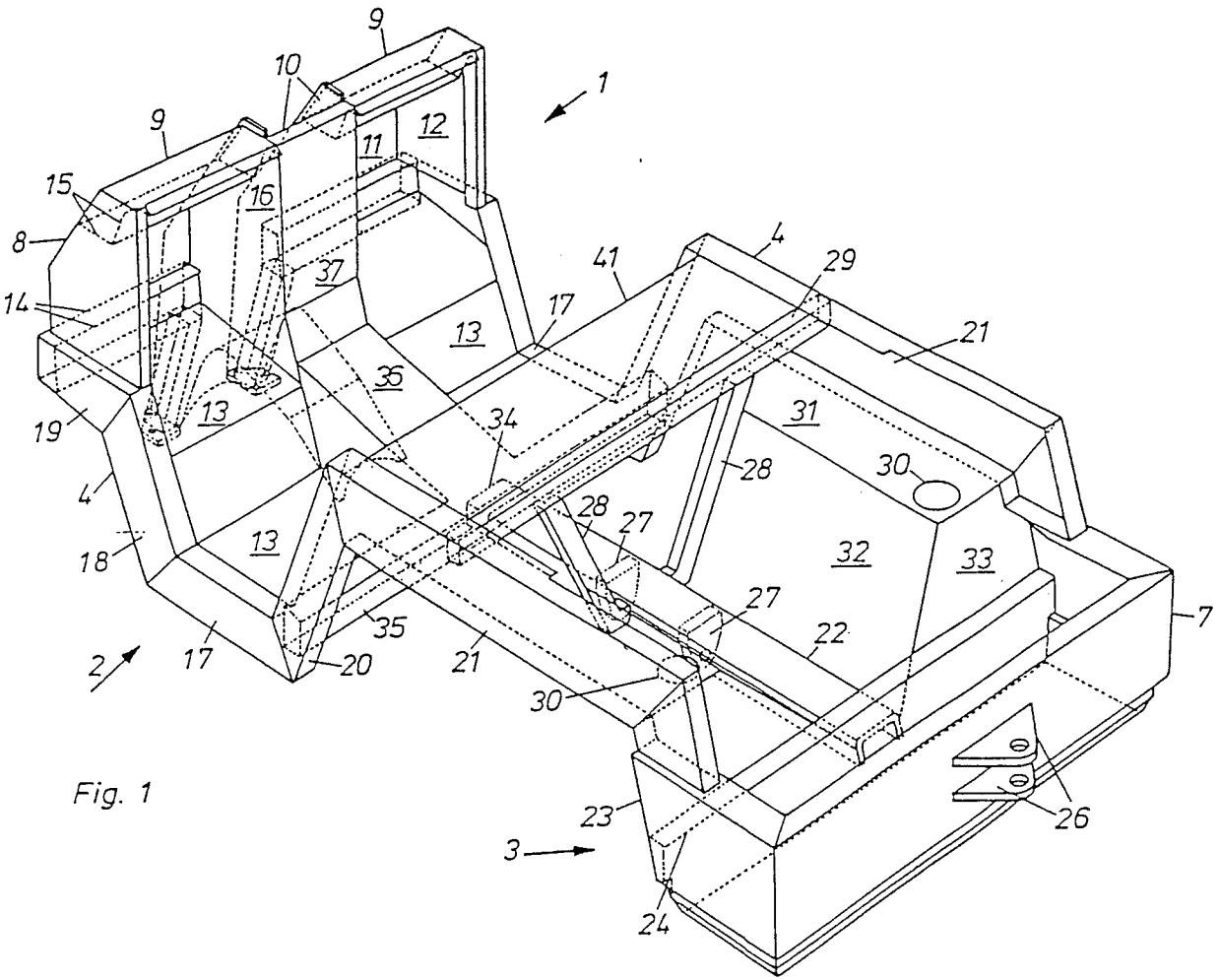
FIG. 1 is a perspective representation of the essential components of a vehicle frame and superstructure.
Figure 4:
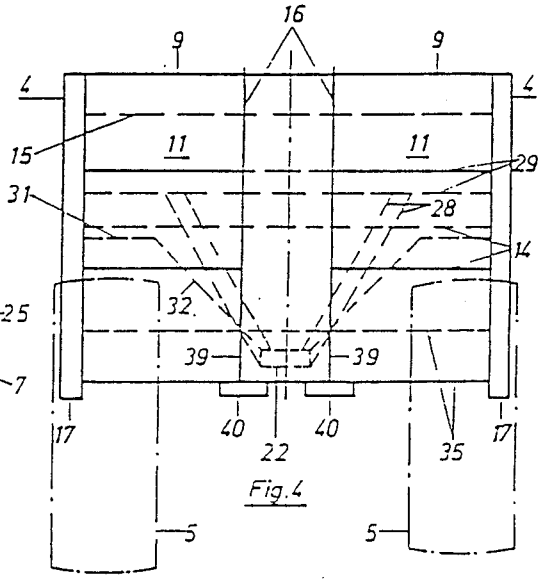
FIG. 4 is a front view of the vehicle of FIG. 2.
Figure 2:
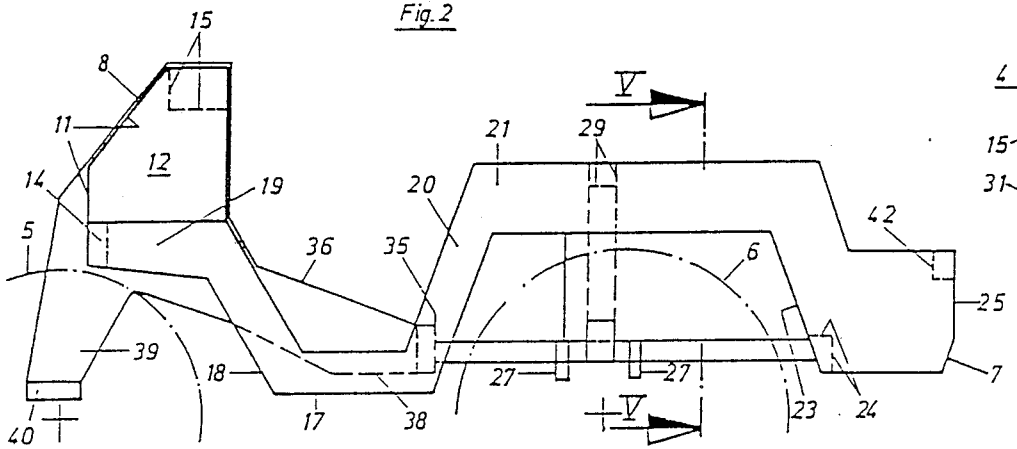
FIG. 2 is a side elevation of the vehicle, in a diagrammatic view.
Figure 3:
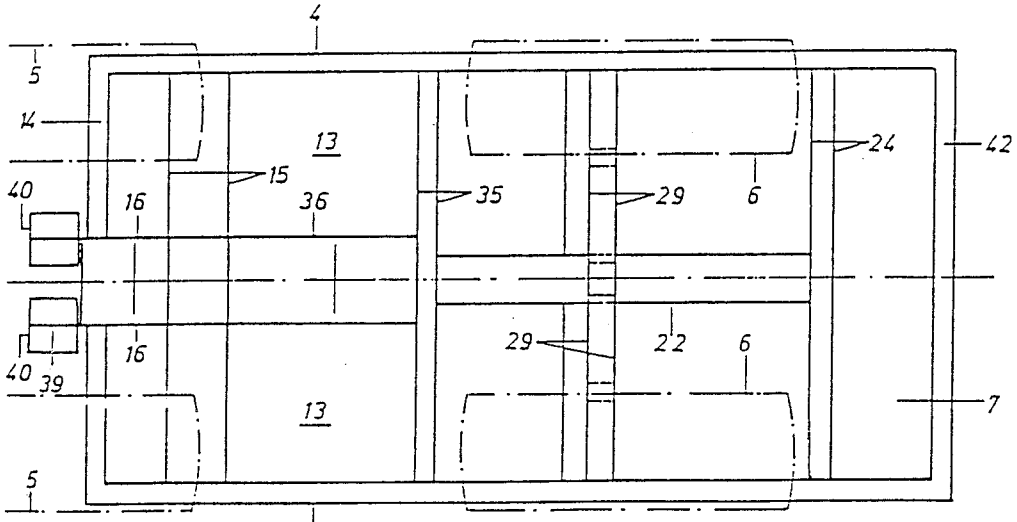
FIG. 3 is a top plan view of the vehicle of FIG. 2.

The vehicle superstructure and frame of FIG. 1 can be divided into the front end section 1, a mid-section 2, and a rear end section 3. Two side elongated frame members 4 run from the front end of the frame to the rear end section 3, arching about half-way over the front wheels and all the way over the back wheels. In FIGS. 2 to 4, the front wheels 5 and the rear wheels 6 are indicated by broken lines. At the rear end of the side elongated frame member 4 there is a rear-end box-shaped frame portion 7 running all the way across the vehicle so that it is behind the rear wheels; on the front end of the side frame members 4, a front-end box-shaped frame portion 8 is fastened, which consists of a right and a left box compartment 9 separated from each other by a tunnel or recess 10 towards the front and disposed between the two box compartments 9, and in which the vehicle end of a material loading boom (not shown) is pivoted. The two box compartments 9 are both open towards the driver's cab and formed of a front plate or wall 11, side plate or wall 12 and a bottom wall 13. Internally the two box compartments 9 are reinforced by two transversal beams, namely a lower front beam 14 and an upper front beam 15. Both beams 14 and 15 are each attached to the inside of the respective adjacent side wall 16 of the tunnel or recess 10; at their outer end the lower front beams 14 are attached each to the inner ends of the side elongated members 4 and the upper front beams 15 are attached to the inside of the side walls 12 of the box compartments 9. The upper and lower transversal beams 14, 15, are each in the form of elongated steel box-shaped sections. They are made either by incorporating prismatic shapes by welding, or by forming the upper front beam 15 from the front plate 11 and by forming the lower front transversal beam 14 from the front plate 11 or from the bottom plate 13.

At the mid-section 2 of the vehicle, the side elongated frame members 4 are bent downwardly to form a step for boarding the vehicle, a threshold 17 being joined by a front sloping section 18 to a front horizontal section 19 and by a rear sloping section 20 to a rear horizontal section 21 of the side elongated frame member 4.

Figure 5:
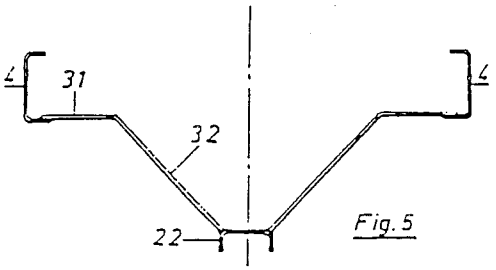
FIG. 5 is a section along line V—V of FIG. 2.

In addition to the two side elongated members 4 there is also provided a central longitudinal frame member 22 in the form of an inverted channel iron as seen from FIG. 5. The rearward end of the central longitudinal member 22 is attached to the inner wall 23 of the rear-end box frame portion 7, at the bottom of the latter, where a rear transverse beam 24 is provided in the form of an additional elongated member of hollow profile. Two trailer hitches 26 are provided on the rear wall of the rear-end box-shaped frame portion 7. The rear-end box 7 is open at the top. The balancing weights and, if necessary, parts of the engine and/or units connected therewith such as oil coolers, water coolers, fan, or the like, are housed in the frame portion 7. The fuel tank and the reservoirs for the vehicle's hydraulic system can also be included, and can be disposed so as to be protected deep within the rear-end box portion 7.

On the underside of the central longitudinal member 22, are fastened two axle flanges 27 for mounting therein of a rear wheel axle. Two sloped struts 28 are fastened to the central frame member 22 approximately between these axle flanges, with their upper ends fastened to a hollow or box-shaped transverse member 29. The transverse frame member 29 connects the two side frame member 4 to one another. A drive unit, which is not shown, and consists essentially of an engine and transmission, has four bearing or support points, namely the two front ones positioned on the hollow transverse member 29 extending over the sloped struts 28 and the two rear ones indicated by circles 30 positioned over the wheel receiving boxes or wells 31, each wheel box consisting of a and positioned welded part made of an upper plate 31, a lateral plate 32, a rear plate 33, and a front plate (not shown), which follows the slope of the rear sloping section 20 of the side frame members 4. These plates of the wheel well can be partially perforated to let additional cooling air reach the engine.

The central longitudinal frame member 22 is fastened at its front end 34 to a central transverse frame member 35 holding together the two side longitudinal frame members 4. In the center the central transverse frame member 35 is connected to an open-bottomed tunnel 36 made from an appropriate steel channel; the central frame member 35 and tunnel 36 can be made by bending from a piece of steel plate. The tunnel 36 to a certain extent is continuation of the central longitudinal frame member 22 toward the front end of the vehicle, where the tunnel 36 is connected to the rear wall 37 of the front tunnel 10.

A sloping wall 41 fastened on the front side of the sloping parts 20 of the side frame members 4 closes off the rear-end motor compartment from the interior of the driver's cabin; it serves simultaneously for the additional stiffening of the central section of the superstructure of the vehicle.

In the side elevation shown in FIG. 2, can be seen also a bottom edge 38 of the tunnel 36 whose side walls merge into the side walls 16 of the tunnel 10, and which are prolonged downwardly by axle plates 39 to the bottom the ends of which are fastened to axle flanges 40 for mounting the front axle (not shown).

A section taken along line V—V in FIG. 2 is represented in FIG. 5. Here the interior of the vehicle's rear end defined by the wheel wells is shown, which is available between the rear wheels for the accommodation of the driving mechanism. It can easily be seen that the lateral wheel plates 32 and the upper wheel plates 31 come together at the top and are welded laterally to the side frame members 4.

Otherwise, in the top view given in FIG. 3 and in the front elevation given in FIG. 4, the same components are identified by the same reference minerals and the spatial arrangement of all components of the frame and vehicle superstructure can be seen.

In the top view shown in FIG. 3, the wheel plates have been omitted for ease of comprehension. The outer frame consisting of the two side frame members 4, the lower front transverse beam 14 and one rear-end transverse beam 42 of the rear-end box portion 7 is shown in solid lines for the sake of simplicity, the rear-end transverse beam 42 having been omitted in FIG. 1.

I claim:

1. In a vehicle, especially a loader of the type having a loading boom linked to the front and a motor suspended at the rear of the vehicle, comprising a rigid frame including a plurality of longitudinal and transverse frame members, two longitudinal lateral frame members extending at two opposite sides of said frame and having arch portions extending over back wheels of the vehicle and in the area of a middle section of the vehicle running at a level of a vehicle floor adjoining a boarding step, the improvement comprising said two longitudinal lateral frame members each having a front section extending partially over a respective front wheel of the vehicle for supporting a front portion of the vehicle, said frame further including a central longitudinal frame member extending at about the level of the vehicle floor between axles of the wheels and rearwardly as far as a rear end of the vehicle, said central longitudinal frame member being joined to a plurality of transversal frame members and having a bottom on which axle flanges for fastening a rear axle are provided, said frame being additionally stiffened by inclusion of parts of a vehicle superstructure in the area of the rear end, front end and the boarding step of the vehicle.

2. The vehicle according to claim 1, wherein said central longitudinal frame member is directly joined to said plurality of transversal frame members.

3. The vehicle according to claim 1, wherein said central longitudinal frame member is joined to said plurality of transversal frame members by struts.

4. Vehicle according to claim 1, wherein at least two longitudinal lateral frame members are joined together at the rear end of the vehicle by a rear-end box-shaped frame portion provided for accommodation of balancing weights.

5. Vehicle in accordance with claim 4, wherein said rear-end box-shaped portion is open at the top thereof for a partial housing of the motor and units connected to the motor.

6. Vehicle according to claim 4, wherein said rear-end box-shaped frame portion is stiffened internally by a rear transverse frame member, to which a rear end of said central longitudinal frame member is connected.

7. Vehicle according to claim 1, wherein said longitudinal lateral frame members are joined together at the front end of the vehicle by a front frame portion including a left-hand box-shaped part and a right-hand box-shaped part which include therebetween a forwardly open passage into which a vehicle end of the loading boom reaches.

8. Vehicle according to claim 7, wherein said passage is formed by two lateral walls which project toward an axis of front wheels and include downwardly extending axle plates having ends to which axle flanges for fastening of the axis of the front wheels are attached.

9. Vehicle according to claim 8, wherein said left-hand and right-hand box-shaped parts of said frame portion are rearwardly open towards a driver's cabin and are formed each by a front plate, a side plate and a floor plate of a vehicle superstructure.

10. Vehicle according to claim 9, wherein in an interior of each of said box-shaped parts an additional transversal frame member is provided, which is connected at one side to a front end of the associated longitudinal lateral frame member and at another side to an adjacent lateral wall of said passage.

11. Vehicle according to claim 9, wherein said central longitudinal frame member, in a longitudinal section thereof between the rear-end box-shaped frame portion and the middle section of the vehicle is attached to a central transversal frame member and is configured as a channel.

12. Vehicle according to claim 7, further including a central transversal frame member extending between said longitudinal lateral frame members and wherein said central longitudinal frame member is connected at a forward end thereof to a tunnel formed as a box-like frame section which is connected at the one end to said central transversal frame member and at another end to said passage.

13. Vehicle according to claim 12, wherein a floor plate extends in the middle section at each side of said tunnel and is fastened to the respective longitudinal lateral frame member and extends forwardly where it forms a bottom of the associated box-shaped part of said front frame portion.

14. Vehicle according to claim 5, wherein additional transversal frame members are provided at a vertical distance from and above said centtral longitudinal frame member, said additional transversal frame members including a rear-end beam parallel to an upper edge of said rear-end box-shaped frame portion and a front-end beam parallel to an upper edge of a front frame portion.

15. Vehicle according to claim 1, wherein said longitudinal lateral frame members are connected together over the rear wheels of the vehicle by a transversal frame member having ends connected to said central longitudinal frame member by struts.

16. Vehicle according to claim 1, wherein at least some of said transverse frame members are formed by shaping a hollow profile section on portions of a vehicle superstructure.

17. Vehicle according to claim 1, wherein said frame includes wells for the rear wheels of the vehicle, said wells being formed by plates welded to one another and to said longitudinal lateral frame members and said central longitudinal frame member to form therewith a stiff structural unit.

* * * * *